United States Patent [19]

Wolfert

[11] Patent Number: 4,762,053

[45] Date of Patent: Aug. 9, 1988

[54] REPLACEMENT FILTERED SOFFIT VENTILATOR

[75] Inventor: Clarke K. Wolfert, Peoria, Ill.

[73] Assignee: Air Vent Inc., Peoria, Ill.

[21] Appl. No.: 56,768

[22] Filed: Jun. 2, 1987

[51] Int. Cl.[4] ..... F24F 13/18

[52] U.S. Cl. ..... 98/37; 55/493; 55/501; 98/DIG. 6

[58] Field of Search ..... 55/493, 501; 98/32, 98/37, DIG. 6

[56] References Cited

U.S. PATENT DOCUMENTS

| | | | |
|---|---|---|---|
| 1,801,949 | 4/1931 | Broudy et al. | 55/493 X |
| 3,154,393 | 10/1964 | Klein et al. | 55/501 |
| 3,570,220 | 3/1971 | Felter | 55/493 X |
| 3,774,377 | 11/1973 | Bishop | 55/501 X |
| 4,325,290 | 4/1982 | Wolfert | 98/42.21 |
| 4,550,648 | 11/1985 | Eagle | 98/DIG. 6 |

*Primary Examiner*—Harold Joyce

*Attorney, Agent, or Firm*—Silverman, Cass, Singer and Winburn, Ltd.

[57] ABSTRACT

A replaceable filtered soffit ventilator including a bracket dimensioned to line an opening in the soffit of a roof, a replaceable filter frame secured within the bracket and dimensioned to be coextensive with the opening, a porous filter media secured within the frame between a wire mesh retainer and a compressible loop to permit the free flow of air through the soffit while restricting the access of insects and dirt thereto.

6 Claims, 1 Drawing Sheet

FIG. 6
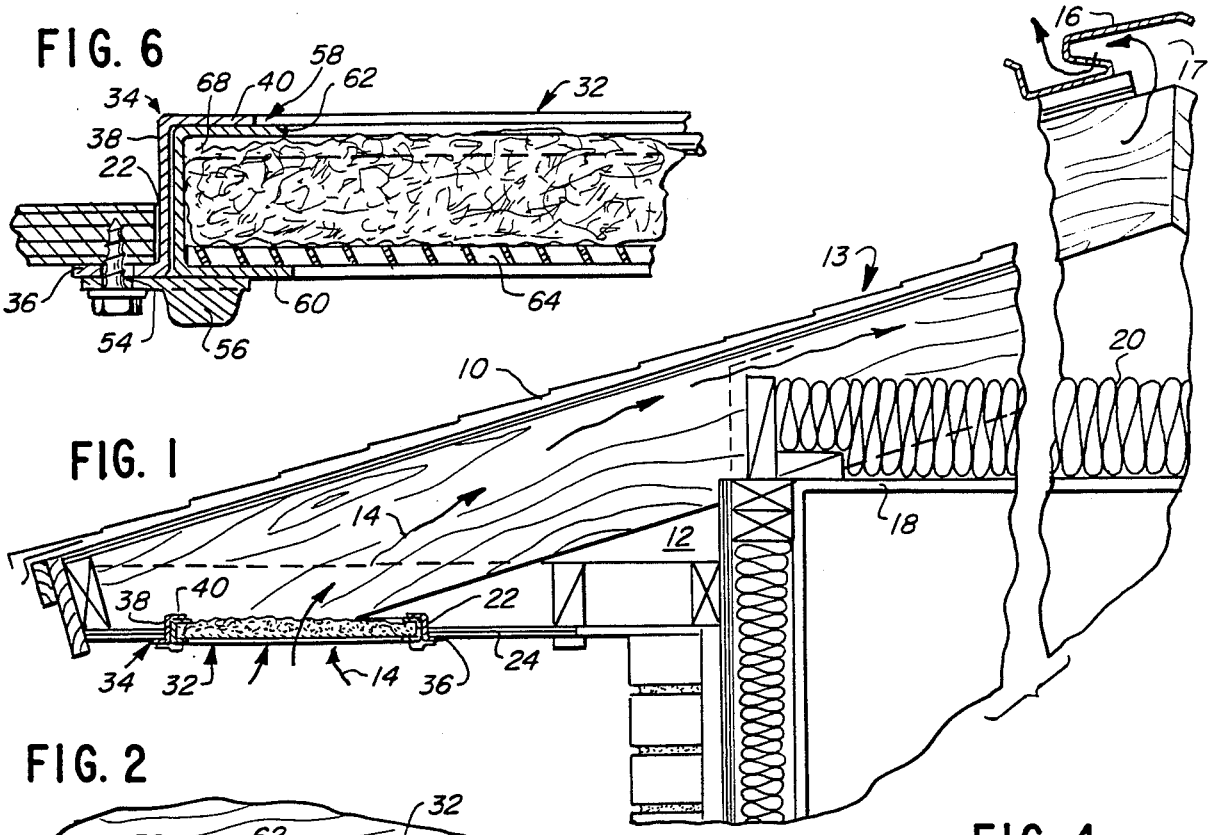
FIG. 1
FIG. 2
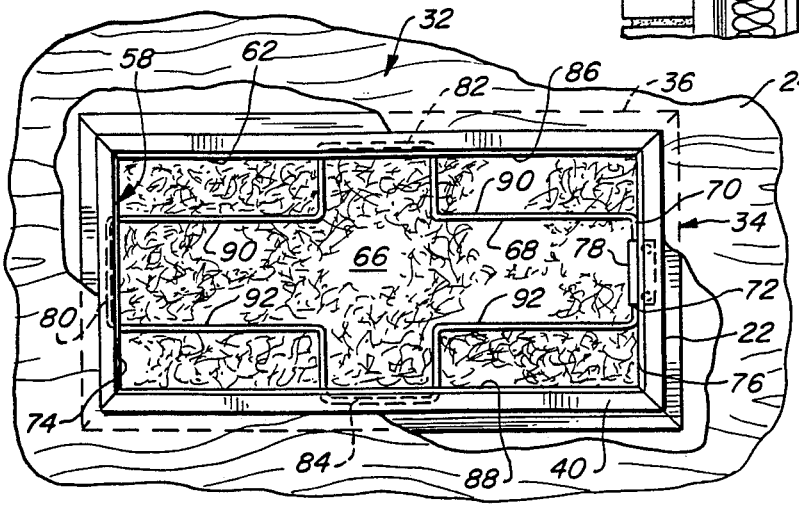
FIG. 4
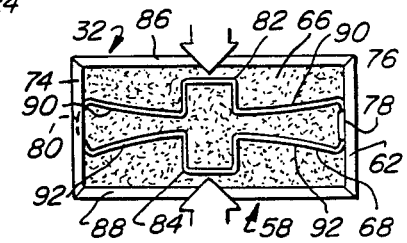
FIG. 5
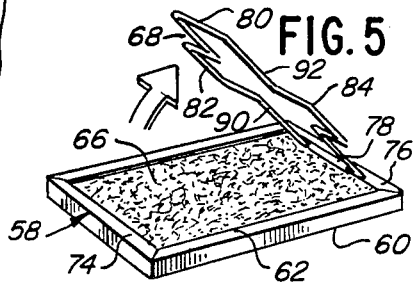
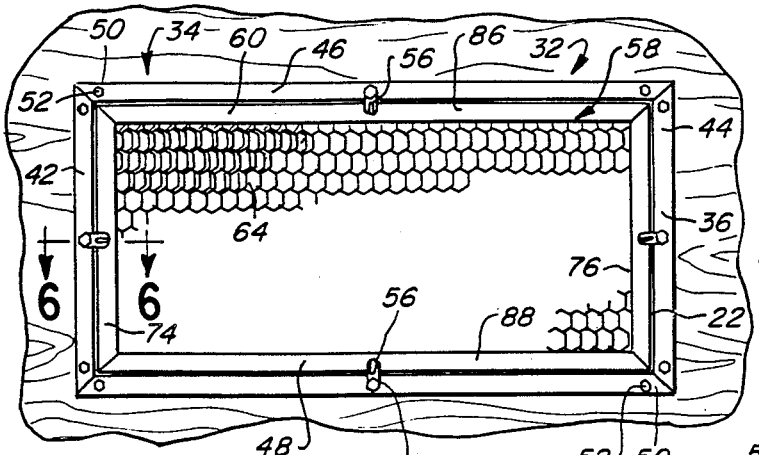
FIG. 3
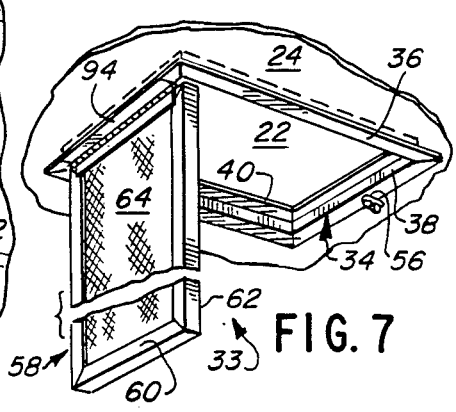
FIG. 7

REPLACEMENT FILTERED SOFFIT VENTILATOR

BACKGROUND OF THE INVENTION

1. Field of the Invention

The invention relates to roof soffit ventilators, and more specifically, relates to an improved soffit ventilator with a replaceable filter element.

2. Description of the Prior Art

Proper and effective attic ventilation of a residential building is necessary in order to prevent accumulation of water vapor in the attic or vacant space below the roof of a building. Such water vapor will condense in a cold attic or crawl space above the living quarters sufficiently to reduce the rating of insulation installed in the attic and can have deleterious effects on the structure of the roof. An important adjunct of such an attic ventilation system is the soffit ventilator, which cooperates with a roof ridge ventilator or other roof ventilators so that such water vapor accumulation in the attic can be avoided. Such a roof ridge ventilator is disclosed in my U.S. Pat. No. 4,325,290.

Conventional attic ventilation systems employ a fixed soffit ventilator which includes an opening in the soffit over which a louvered metal plate is secured. The metal plate may be provided with a metal screen designed to prevent the intrusion of insects and other pests. A major disadvantage of conventional soffit ventilators is that over extended periods of use, the ventilator openings become clogged with dirt, trapped insect remains and/or other organic material, thereby severely restricting and ultimately preventing vital air circulation capability. However, since conventional soffit ventilators are fixed to the soffit and often are sealed thereto by repeated painting, it is quite difficult, if not impossible, to remove them for cleaning, without damaging the ventilators so that they must be replaced.

Another disadvantage of conventional soffit ventilators is attributable to the wire screens used to prevent penetration of insects and other pests into the attic, which often are of an improper mesh gauge sufficient to restrict entry of smaller insects. When finer mesh screens are used, air flow through the ventilator is undesirably restricted.

Thus, there is a definite need for a soffit ventilator which is accessible for cleaning without dismantling from the soffit and which has a filter element which is both replaceable and capable of preventing incursion of substantially all insects or other pests into the attic through the soffit ventilator without restricting air flow.

SUMMARY OF THE INVENTION

The invention provides a filtered soffit ventilator having a replaceable filter and which permits the free flow of air through the ventilator while restricting the access of insects to the interior of the roof. A bracket is fixed within a ventilation opening in the soffit and is dimensioned to line that opening. A filter frame is provided which is replaceably secured within the bracket, either by fasteners such as wing nuts or a combination of wing nuts and a hinge. The filter frame is constructed to retain a replaceable filter media therein between a mesh cloth on the exterior side of the frame, and a specially designed compressible loop on the inside of the frame. The filter frame and enclosed filter media are dimensioned to cover the opening in the soffit so that air must pass through the filter.

In operation, when the filter becomes clogged, the frame is detached from the bracket by twisting the wing nuts, and the filter media is replaced by unfastening the compressible loop. In cases where the frame is hinged in the bracket, the frame can be pivoted downwardly for easy access to the filter media. Efficient below-the-roof ventilation of a building is thus maintained without dismantling or damaging the ventilator structure.

BRIEF DESCRIPTION OF THE DRAWINGS

FIG. 1 depicts a fragmentary side elevational view of a conventional residential building roof partially in section to show installation of the filtered soffit ventilator embodying the invention;

FIG. 2 is a top plan view of said ventilator shown installed in FIG. 1;

FIG. 3 is a bottom plan view of said ventilator viewed from below the soffit installation of FIG. 1;

FIG. 4 is a plan view of the ventilator shown in FIG. 2 with the compressible loop compressed for replacement of the filter element;

FIG. 5 is a perspective view of the ventilator of the invention showing the hinging action of the compressible loop;

FIG. 6 is an enlarged partial sectional view taken along line 6—6 of FIG. 3 and in the direction indicated generally; and FIG. 7 is a perspective view of an alternate embodiment of the ventilator embodying the invention shown installed in a soffit.

DESCRIPTION OF THE PREFERRED EMBODIMENT

Referring to FIG. 1, a conventional roof 10 and attic or roof crawl space 12 of a residential building 13 is depicted in section, with the air flow pattern therethrough indicated by arrows designated 14. The roof 10 is shown having a roof ridge ventilator 16 installed over the ridge opening 17 in a conventional manner. The attic or space 12 is bounded at its upper margin by the roof 10, and at its lower margin by the ceiling 18, which in the present embodiment is shown with an overlying layer of insulation 20. The air flow 14 enters the attic 12 through opening 22 in the soffit 24. Multiple soffit openings 22 preferably are provided in a typical roof 10. Soffit ventilators are normally located in the openings 22 to restrict the entrance of insects, other pests and debris into the attic 12. The ventilator of the invention is designated generally by the reference character 32 and is shown positioned within the opening 22.

Conventional ventilators are generally flat plates of sheet metal or other rigid material into which a plurality of louvers or air slots are provided by stamping or other fabrication techniques. Conventional ventilators of this type may be provided with a sheet of screen mesh behind the louvers to act as a filter. However, regardless of whether a filter screen is provided or not, conventional ventilators are only marginally effective in restricting smaller insects from entering the attic 12 through the soffit openings 22. In addition, conventional ventilators are subject to clogging of the slots by dirt, insect debris and other organic matter or by repeated painting. This clogging restricts air flow through the soffit openings 22, and is detrimental to roof longevity.

The filtered soffit ventilator 32 of the invention is illustrated in greater detail in FIGS. 2, 3 and 6. The ventilator 32 is shown mounted in the opening 22 of the soffit 24. The opening 22 is lined by a bracket 34, which in the present embodiment is rectangular and has an exterior facial flange 36, a central wall 38 and an interior lip 40 projecting toward the center of the opening 22. Both the facial flange 36 and the interior lip 40 extend around the entire periphery of the opening 22. The flange 36 is also provided with a pair of sides 42, 44, an upper portion 46 and a lower portion 48 (shown best in FIG. 3), each of which is provided with at least one mounting aperture 50 for a threaded fastener 52 to secure the bracket 34 to the soffit 24. The sides 42, 44, and the upper and lower portions 46 and 48 are also each provided with an aperture 54 through which a long-armed wing nut or similar fastener 56 is threaded for axial rotation thereabout.

Referring now to FIGS. 2–6, a frame 58 is shown having an exterior face 60 and an interior face 62 and is mounted within the bracket 34 so that the interior face 62 engages the interior lip 40, and the exterior face 60 is within reach of the wing nuts 56. The frame 58 is thus retained within the bracket 34. Both the exterior and interior faces 60 and 62 may be said to form inwardly projecting peripheral lips. A rigid sheet of mesh or screen cloth forms a grill or filter retainer 64, which is fastened to the exterior face 60 of the frame 58, and for aesthetics, may be placed directly underneath the face 60. A sheet of porous filter media 66 is replaceably located within the frame 58. The media 66 is fabricated of synthetic fibrous material such as fiberglass and is provided in a sheet which fills the interior of the frame 58. The media 66 has a fine mesh which prevents penetration by the smallest insect pests, yet allows the free flow of air therethrough and facilitates the air flow 14.

The media 66 is retained within the frame 58 and against the grill 64 by a compressible retaining loop 68. In the preferred embodiment, the loop 68 is a single strand of flexibly rigid metal wire having two ends 70 and 72. The loop 68 is configured by bending or other methods into the generally rectangular shape shown best in FIG. 2, so that the ends 70, 72 are both located on one of the two sides 74 or 76 of the frame 58 and are mounted to a hinge 78 attached, in the preferred embodiment, to the side 76 of the frame 58. The loop 68 is configured to have a generally truncated end 80 designed to be inserted underneath the side 74 opposite the hinge 78. The loop is also provided with upper and lower truncated extensions 82 and 84, each of which can be inserted underneath the respective upper and lower sides 86, 88 of the interior side 62. In addition, the loop 68 is also provided with upper and lower gripping portions 90 and 92, the use of which will be described presently.

Once the media 66 has been placed within the frame 58 against the retaining grill 64, the loop 68 is swung on hinge 78 so that the end 80 is adjacent to the side 74 of the frame interior side 62. The loop 68 is then forced against its own biasing force underneath the side 74 of the interior side 62. Referring now to FIG. 4, the upper and lower gripping portions 90 and 92 then are grasped by the installer to squeeze those portions together, so that the upper and lower extensions 82, 84 may be inserted underneath the respective upper and lower sides 86, 88 of the frame 58. The installer then releases the gripping portions 90, 92 to allow the loop 68 to spring against the interior of the frame 58. The media 66 is thus releasably secured within the frame 58.

Referring now to FIG. 7, an alternate embodiment of the present soffit ventilator 33 is shown, wherein the frame 58 is secured within the bracket 34 by one-armed wing nuts 56 as shown previously on only three sides, and is provided with a hinge 94 on the fourth side which is also mounted to the bracket 34. The hinge 94 may be located on any one of the four sides 74, 76, 86, 88 of the frame exterior 60. The ventilator 33 depicted in FIG. 7 is otherwise identical to the ventilator depicted in FIGS. 1–6.

In operation, the filtered soffit ventilator 32 of the invention is secured within the opening 22 of the soffit 24 by the bracket 34. The frame 58, in which the media 66 is retained between the grill 64 and the compressible loop 68, is releasably secured against the interior lip 40 of the bracket 34 by the one-armed wing nuts 56. When the filter media 66 requires replacement, the frame 58 is removed from the bracket 34, and the compressible loop 68 is released by squeezing together the gripping portions 90 and 92 to allow the replacement of the media 66. Alternatively, the frame 58 is hinged to the bracket 34 to conveniently drop down upon release of the wing nut 56, exposing the compressible loop 68 and filter media 66 for replacement.

Thus, the filtered soffit ventilator of the invention provides a covering for a soffit opening which allows the free flow of air therethrough while restricting the penetration of insect pests, dirt and other unwanted material into the attic area. The filter media is easily accessible and may be replaced periodically to optimize air flow through the attic.

While a preferred embodiment of the invention has been shown, it will be understood that the invention may be otherwise embodied within the scope of the appended claims. Minor variations in the structure and in the arrangement and size of the various parts may occur to those skilled in the art without departing from the spirit and scope of the invention.

I claim:

1. A filtered soffit ventilator comprising:

a bracket dimensioned to line an opening in said soffit and to be fastened therein;

a filter frame releasably secured within said bracket by at least one fastener mounted to the bracket, said frame having an interior face forming an inwardly projecting peripheral lip, and an exterior face, and dimensioned to be approximately coextensive with said opening and having upper and lower edges and first and second side edges;

a rigid mesh filter retainer secured to the exterior face of said frame and being approximately coextensive therewith to cover said opening;

a porous filter media releasably secured within said frame and approximately codimensional with said filter retainer to cover said opening; and a compressible loop hinged to said frame and designed to secure said filter meda against said retainer, said loop including a strand of flexibly rigid material, said strand being formed into a substantially rectangular shape with upper and lower edges and first and second side edges corresponding with said edges of said frame, said upper and lower edges each including an extended central portion engaging said upper and lower edges of said frame located between two relatively recessed portions which form gripping means for compressing said loop for insertion beneath said peripheral lip, said first and second side edges of said loop engaging said corresponding side edges of said frame so that said loop retains said filter media therein on all sides thereof.

2. The ventilator defined in claim 1 wherein said frame is hinged on said bracket.

3. In a filtered soffit ventilator provided with a bracket lining an opening in said soffit, and a frame designed to be secured within said bracket and having an interior face forming an inwardly projecting peripheral lip, upper and lower edges and first and second side edges, a compressible filter media retaining loop designed to retain a filter media within said frame, comprising:

a single strand of flexibly rigid material, said strand being formed into substantially rectangular shape with upper and lower edges and first and second side edges corresponding with said edges of said frame, said upper and lower edges including an extended central portion engaging said upper and lower edges of said frame located between two relatively recessed portions which form gripping means for compressing said loop for insertion beneath said peripheral lip, said first and second side edges of said loop engaging said corresponding side edges of said frame so that said loop retains said filter media therein on all sides thereof.

4. The loop defined in claim 3 wherein said two ends of said loop are fixed to said frame in hinged fashion.

5. The loop defined in claim 3 wherein said frame is hinged on said bracket.

6. The loop defined in claim 3 including a rigid mesh filter retainer secured to the exterior face of said frame and being approximately coextensive therewith to cover said opening, said filter media retained by said loop against said filter retainer.

* * * * *